United States Patent [19]

Seeley

[11] Patent Number: 4,557,246

[45] Date of Patent: Dec. 10, 1985

[54] BRICK CLEANING MACHINE

[76] Inventor: Thomas E. Seeley, 7669 Tingley La., Klamath Falls, Oreg. 97601

[21] Appl. No.: 633,494

[22] Filed: Jul. 23, 1984

[51] Int. Cl.[4] ..... B28D 1/20

[52] U.S. Cl. ..... 125/26; 125/5

[58] Field of Search ..... 125/26, 5; 51/206 R

[56] References Cited

U.S. PATENT DOCUMENTS

| | | | |
|---|---|---|---|
| 547,746 | 10/1895 | Turner | 125/26 |
| 1,031,107 | 7/1912 | Cole | 125/26 |
| 1,563,081 | 11/1925 | Funk | 125/26 |

FOREIGN PATENT DOCUMENTS

| | | | |
|---|---|---|---|
| 927659 | 11/1947 | France | 125/26 |
| 1301722 | 1/1973 | United Kingdom | 125/26 |

*Primary Examiner*—Harold D. Whitehead

*Attorney, Agent, or Firm*—Kolisch, Hartwell & Dickinson

[57] ABSTRACT

An apparatus for removing mortar from used bricks which includes breaker means for breaking and dislodging mortar, penetration means operable to penetrate a layer of mortar, and scraper means for scraping and providing a finished surface on a brick. The breaker means, penetration means and scraper means are mounted on an elongate frame which in turn is mounted adjacent a track having a powered conveyor. The powered conveyor moves a used brick along the track through a cleaning station which includes multiple frames containing mortar-removing means. The apparatus may be incorporated into a machine containing multiple cleaning stations which provides for efficient, rapid cleaning of used brick and provides used brick which is substantially ready to be incorporated into new structures.

2 Claims, 5 Drawing Figures

BRICK CLEANING MACHINE

BACKGROUND AND SUMMARY OF THE INVENTION

The instant invention relates to brick-cleaning machinery. Specifically, the instant invention provides means for removing mortar from used brick thereby producing clean used brick suitable for use in construction.

Incorporation of used brick into new structures is considered aesthetically pleasing by many people. A source of used brick is found in buildings which are being torn down to make way for new construction. Before used brick may be placed in new construction, the mortar which was previously used to hold the brick together in the old structure must be removed, and the surfaces of the brick which have mortar adhering to them must be clean so that the brick is ready to receive a new coat of mortar.

An object of the instant invention is to provide apparatus for removing mortar from used brick, thereby preparing the used brick for use in new construction.

Another object of the instant invention is to provide means for removing mortar from used brick which breaks the mortar off of the brick and then scrapes the sides of the brick clean.

A further object of the instant invention is to provide a machine which incorporates mortar-removing means in a plurality of cleaning stations for preparing used brick for subsequent use.

Yet another object of the instant invention is to provide brick-cleaning means which are powered by movement of a used brick through a brick-cleaning station.

The instant invention includes a pair of brick-cleaning rails which are mounted on either side of a track with a powered conveyor. Another brick-cleaning rail is mounted above the track. Mortar-removing means are mounted on the rails and include a mortar breaker, a rotatably mounted sprocket assembly which penetrates the mortar remaining on a brick and a scraper for finishing the brick and removing any mortar remaining on the brick once it has passed through the breaker and mortar penetration means. The rails are yieldably spring-biased to allow passage of various sized bricks therethrough and to provide adequate pressure on the sides and top of a brick to remove the mortar still adhering to a brick. The brick-cleaning rails are incorporated into a machine which has a powered conveyor to move a used brick through the rails. The machine includes an infeed area where bricks are fed into the machine, a cleaning station, which includes the brick-cleaning rails, and a discharge station. A discharge chute is provided to receive the common output of several cleaning stations.

These and other objects and advantages of the instant invention will be more fully apparent as the description which is follows is read in conjunction with the drawings.

DETAILED DESCRIPTION OF A PREFERRED EMBODIMENT

Figure 1:
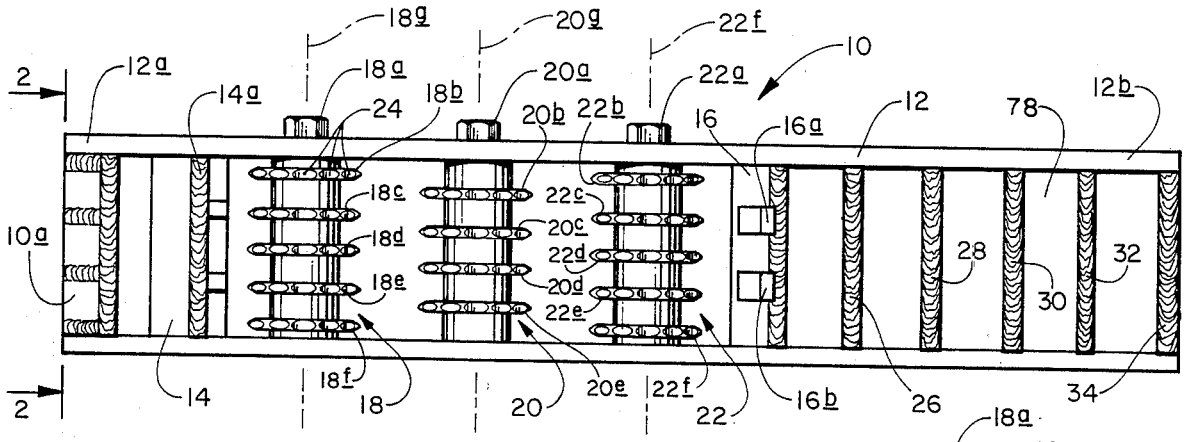
FIG. 1 is a side view of a brick-cleaning rail.
Figure 2:
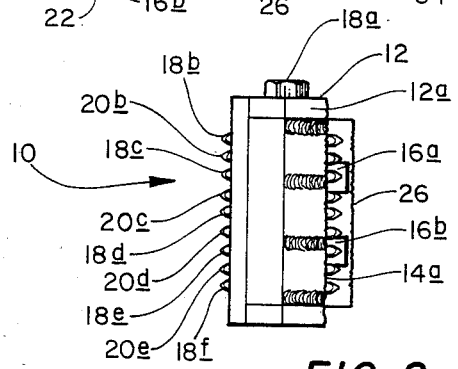
FIG. 2 is an end view of the rail, taken generally along line 2—2 in FIG. 1.

Turning now to FIGS. 1 and 2, a brick-cleaning rail is shown generally at 10. Rail 10 includes an elongate frame, or frame means, 12 which includes an intake end 12*a* and an off-bearing end 12*b*.

Breaker means, including an initial breaker plate 14 and a second breaker plate assembly 16 are mounted on frame 12. Plate 14 has a roughened edge 14*a* (see FIG. 2) protruding beyond the margin of frame 12. Plate assembly 16 includes two breaker plates 16*a*, 16*b*, which also protrude beyond the margin of frame 12.

Rotatable brick-cleaning instrumentalities having mortar penetrating means are shown generally at 18, 20 and 22. Each instrumentality or penetration means, and using penetrating means 18 as an example, includes a rotatable mounting, which in the preferred embodiment, takes the form of a shaft 18*a* having a hexagonal head on one end. The shaft extends between the long sides of frame 12. Sprockets, such as those shown at 18*b*, 18*c*, 18*d*, 18*e*, and 18*f* are individually rotatably mounted on shaft 18*a* and are rotatable about mounting 18*a* and an axis 18*g* which extends through the center of mounting 18*a* and transversely of frame 12. The sprockets are provided with projecting teeth 24. The teeth on the sprockets project beyond the margin of frame 12. Instrumentalities 20 and 22 are similarly constructed with multiple sprockets.

As depicted in FIG. 1, three brick-cleaning instrumentalities 18, 20, and 22 are provided and are spaced from each other along the frame. It should be noted that the sprockets on shaft 18 and 22 are similarly spaced from the long edge of frame 12, and those on instrumentality 20 are offset from those on 18 and 22 thereby providing substantially full distribution of teeth 24 between the lateral edges of frame 12.

Located adjacent off-bearing end 12*b* of the frame is the scraper means which includes plural scraper plates 26, 28, 30, 32 and 34.

The brick-cleaning instrumentalities are located intermediate the initial breaker plate and the second breaker plate on the frame. The scraper means, breaker means and the brick-cleaning instrumentalities comprise mortar-removing means.

A guide plate 10*a* is located adjacent the intake end 12*a* of frame 12. The frame and the components mounted thereon comprise brick-cleaning means or rails.

Figure 3:
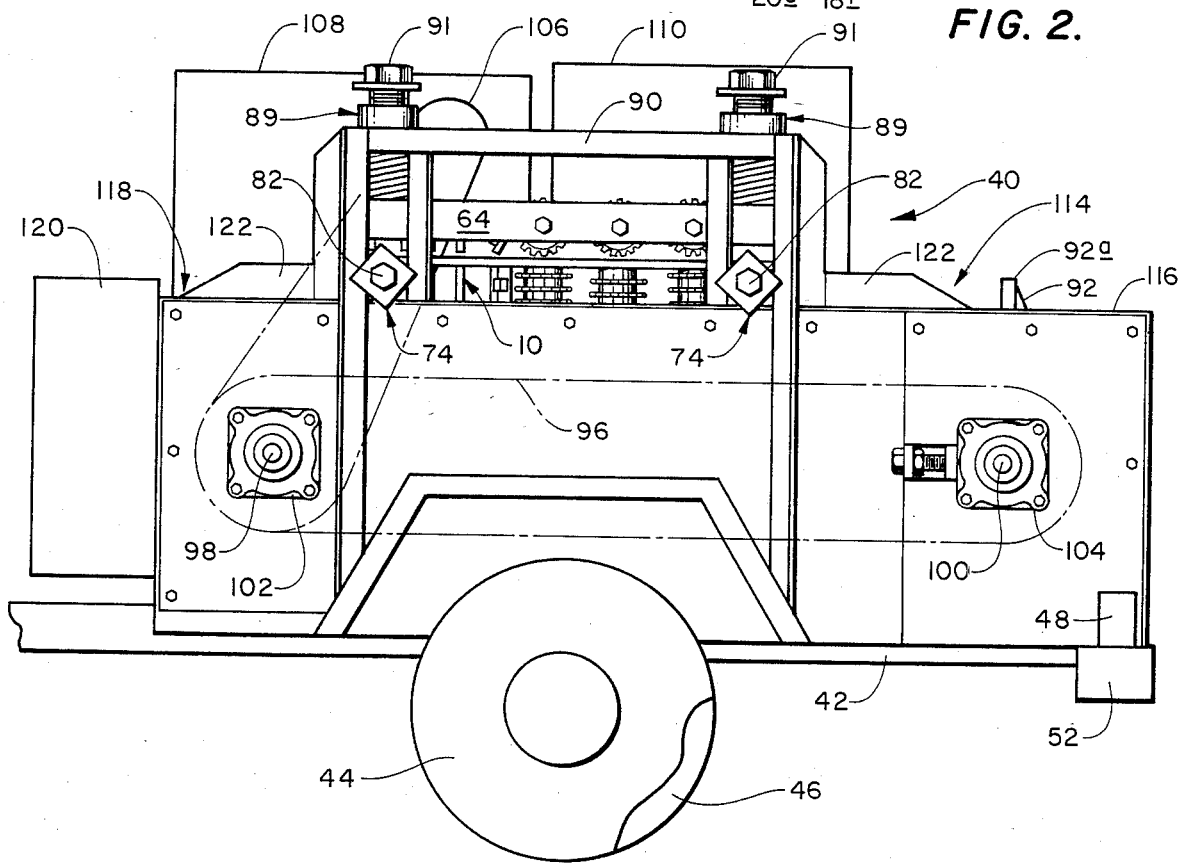
FIG. 3 is a side view of a brick-cleaning machine incorporating the rail of FIG. 1.

Turning now to FIG. 3, a machine for removing mortar from used brick is shown generally at 40. Machine 40 is vehicle mounted for easy movement to a site where used bricks are available. Machine 40 includes a frame 42, a pair of wheels 44, 46, and because the vehicle is intended for on-the-road use, tail lights 48 and a rear bumper 52 are also provided. A hitch (not shown) is located at the forward end (left of FIG. 3) of frame 42 for attaching the machine to a towing vehicle.

Figure 4:
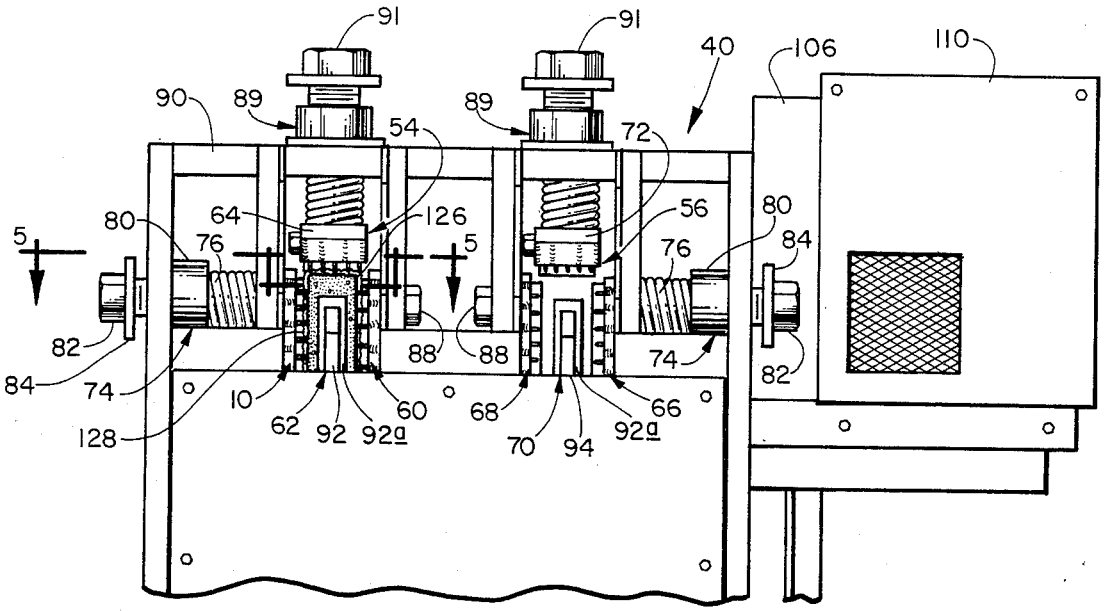
FIG. 4 is an enlarged fragmentary end view of a brick-cleaning machine depicting a brick in a brick-cleaning station.

Machine 40, and now referring to FIG. 4, includes two cleaning stations 54, 56. Each cleaning station contains three brick-cleaning rails mounting mortar-removing means. Cleaning station 54 includes rail 10 and another rail 60 mounted on either side of a track, shown generally at 62. Rails 10 and 60 are also referred to herein as a pair of side rails. Rail 60 is substantially a mirror-image embodiment of rail 10. Another, overhead rail 64 is mounted above track 62. Overhead rail 64 includes the same components as do rails 10 and 60, but is slightly narrower between the sides of the frame.

Track 62 defines a path, or elongate slide surface, along which a brick travels. The other cleaning station 56 also includes a pair of side rails 66, 68, and an overhead rail 72. A track 70 passes through cleaning station 56.

Figure 5:
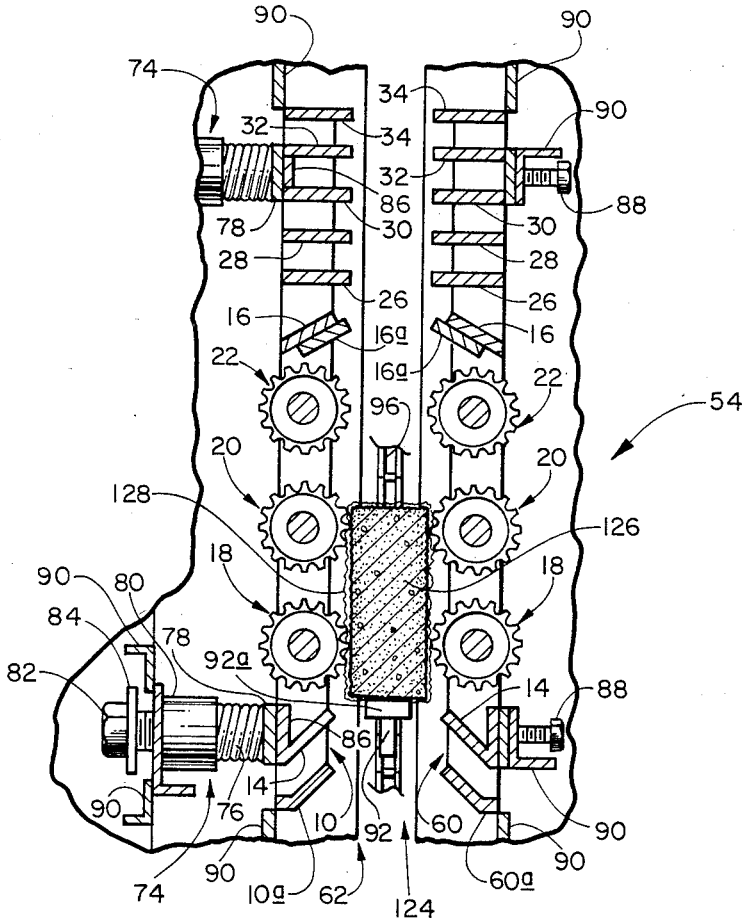
FIG. 5 is a view of a cleaning station incorporating brick-cleaning rails with portions broken away to show detail, taken generally along the line 5—5 of FIG. 4.

Referring now to FIG. 5, a spring-biased mount is shown generally at 74. The mount includes a coil spring 76. A pressure plate 78 is located adjacent one end of spring 76 while the other end of spring 76 is received within a retaining cup 80. A large bolt 82 extends through an opening in the end of cup 80 and is fixedly, rotatably received within pressure plate 78. A threaded washer 84 is interposed the head of bolt 82 and cup 80. Bolt 82 may be rotated relative washer 84 bringing washer 84 into contact with cup 80 thereby compressing spring 76. When washer 84 is located adjacent the head of bolt 82, spring 76 is free to urge plate 78 against a pressure pad 86, carried on rail 10. The spring-biased mount therefore urges rail 10 towards the center of track 62, thereby urging the mortar-removing means towards a brick passing through cleaning station 54.

Rail 60, in the preferred embodiment, is fixed along side track 62 and, referring to FIG. 5, is held in place by bolts 88 located at opposite ends of the rail.

Referring now to FIG. 4, overhead rail 64 is yieldably and resiliently supported over track 62 by spring-biased mounts 89, which are similar to mount 74 used in conjunction with rail 10. Mounts 89 are supported by a framework 90, which is attached to machine 40. Rather than the pressure plate/pressure pad arrangement of mount 74, mount 89 utilizes bolts, such as bolt 91 which are rotatably attached to rail 64 to both support the rail in an elevated position and to provided resistance to an upward force generated by a brick moving through cleaning station 54.

The mounting arrangement for the rails by the framework and the mounts provides that the frame and track are relatively yieldable. Additionally, the mortar-removing means mounted on the rails are yieldable relative a brick moving through the cleaning station.

Tracks 62 and 70 include powered conveyor means or conveyors. The conveyors include dogs, such as those shown at 92 and 94 for propelling a brick along the track through a cleaning station. The dogs include a face pad, such as 92*a*. Referring now to FIG. 3, the dogs are attached to an endless chain 96, shown in phantom lines, which moves over a pair of shafts 98, 100 which are rotatably mounted in bearings 102, 104, respectively.

Shaft 98 is driven by a drive chain which in turn is driven by a drive gear, both of which are enclosed in housing 106. The drive gear is mounted on an output shaft of a gear reduction unit contained in housing 108. The gear reduction unit is connected to a gasoline powered engine (not shown) which is enclosed in engine housing 110. Thus the multiple cleaning stations and their associated powered conveyors are driven by a common drive motor enclosed in housing 110.

To complete the description of machine 40, the machine includes an infeed area 114 located at the rear (right side of FIG. 3) end of the machine. Infeed area 114 includes a lay-up table 116 which may be used to receive bricks prior to their being placed on the tracks for movement into the cleaning stations. A discharge area 118 is located at the opposite end of the machine. A discharge chute 120 is positioned adjacent discharge area 118 and is positioned to receive the common output of multiple cleaning stations.

Guide plates 122 are located adjacent the end of the cleaning station on either side of the track. Referring to FIG. 5, the intake ends of the side rails form a funneled throat, shown generally at 124, which assists in properly aligning a brick entering a cleaning station.

Plates 14 and 16*a*, 16*b* of the breaker means all incline at an acute angle relative to the path of a brick advancing toward the plates. Thus, the plates press and rub against the surface of a brick as such advances past a breaker means with dislodging of loose material. The projecting teeth of the sprockets in penetrating means 18, 20, 22 have a different action in that the teeth through penetration loosen mortar on the surface of a brick. Scraper plates 26, 28, 30, 32, and 34 of the scraper means have flat brick-contacting terminal surfaces paralleling and facing the brick as such moves in its path and these terminal surfaces join along scraping edges with sides of the plates. The plates are disposed normal to the path of the brick. Thus, the scraping edges function to scrape mortar from a brick in a plane defined by the terminal surfaces of the scraper plates.

In use, a brick 126, which has a layer of mortar 128 on its sides, is positioned on, for example, track 62, with its clean side facing downward on the slide surface of the track. A conveyor dog 92 propels the brick along the track into funnel throat 124. As the brick enters the cleaning station, rail 10 is displaced laterally away from track 62, and rail 64 is displaced upwardly from the track, with the mortar-removing means on the rails contacting the mortar on the brick. As the brick moves through the initial breaker plates, large, loose pieces of mortar are removed from the brick. The brick then proceeds through rotatable brick-cleaning instrumentalities, as shown in FIG. 5, with the penetration means penetrating the mortar remaining on the brick, thereby loosening the mortar. The teeth of the sprockets of the brick-cleaning instrumentalities protrude into the path and are of sufficient hardness to penetrate the mortar without damaging the brick. The cleaning instrumentalities are thus rotated by the action of the brick moving through the cleaning station.

The brick then contacts breaker bars on the second breaker plate. The breaker bars serve to dislodge mortar which has been penetrated by the teeth on the brick-cleaning instrumentality. The brick then passes through the multiple plates of the scraper means where any remaining small pieces of mortar are removed, and the mortar-bearing faces of the brick are scraped sufficiently clean to be ready for reuse. The brick exits the cleaning station to the discharge area of the machine where it encounters discharge chute 120, ultimately landing on a suitable pallet where the now-clean used bricks are stacked.

While a preferred embodiment of the invention has been described, it is appreciated that variations and modifications may be made without departing from the spirit of the invention.

It is claimed and desired to secure by Letters Patent:

1. Brick-cleaning apparatus for removing mortar from the sides of used brick, the apparatus comprising, a frame, conveyor means mounted on the frame for moving a brick along an elongate path, said path having infeed and off-bearing ends, and brick-cleaning means disposed along said path engageable with the sides of a brick as such moves along said path and operable to remove mortar lodged on said sides, said brick-cleaning means including a breaker plate disposed adjacent the feed end of said path inclined at an acute angle relative to the path of an advancing brick which presses and rubs against the sides of a brick to dislodge mortar, rotatable penetration means located in said path downstream from said breaker plate with penetrating teeth that penetrate and loosen mortar, and a scraper plate located downstream in said path from said penetration means disposed normal to said path and having a flat terminal surface paralleling and facing a brick moving in said path joining with a scraping edge that scrapes mortar from the brick.

2. The brick-cleaning apparatus of claim 1, which further includes another breaker plate inclined at an acute angle relative to the path of an advancing brick which presses and rubs against the brick to dislodge mortar, said other breaker plate being located intermediate said penetration means and said scraper plate.

* * * * *